United States Patent [19]

Saar

[11] 4,090,707

[45] May 23, 1978

[54] TENNIS RACQUET SOUNDING DEVICE

[76] Inventor: Raymond K. Saar, 860 Glendenning, San Bernardino, Calif. 92404

[21] Appl. No.: 681,440

[22] Filed: Apr. 29, 1976

[51] Int. Cl.[2] ..... A63B 69/38

[52] U.S. Cl. ..... 273/29 A

[58] Field of Search ..... 273/29 A, 74, 67 R, 273/73 R, 73 D, 73 L, 25, 26 R, 26 A, 102.1 B, 76

[56] References Cited

U.S. PATENT DOCUMENTS

| | | | |
|---|---|---|---|
| 3,820,785 | 6/1974 | Occhipinti | 273/73 R X |
| 3,874,666 | 4/1975 | Ross | 273/73 R |

FOREIGN PATENT DOCUMENTS

| | | | |
|---|---|---|---|
| 1,376,724 | 9/1974 | France | 273/73 R |
| 3,126 of | 1885 | United Kingdom | 273/73 R |
| 204,113 | 9/1923 | United Kingdom | 273/73 L |

*Primary Examiner*—Richard J. Apley
*Assistant Examiner*—T. Brown
*Attorney, Agent, or Firm*—Christie, Parker & Hale

[57] ABSTRACT

A sounding device for attachment to the strings of a tennis racket which provides a unique audible sound which indicates where on the tennis racket the ball is struck by the racket. The device includes a frame for clamping a thin plastic diaphragm against the surface of the strings in the central region of the racket. The frame includes a sounding board which extends parallel to the diaphragm for amplifying the sound produced by the diaphragm when the adjacent strings are struck by the tennis ball.

7 Claims, 7 Drawing Figures

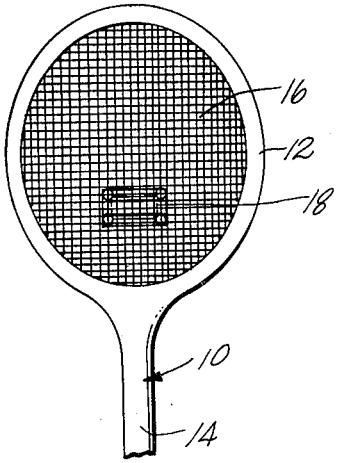
Fig. 1
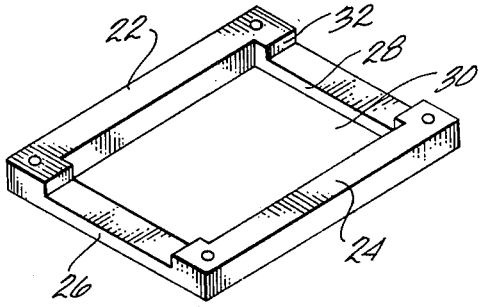
Fig. 5
Fig. 2
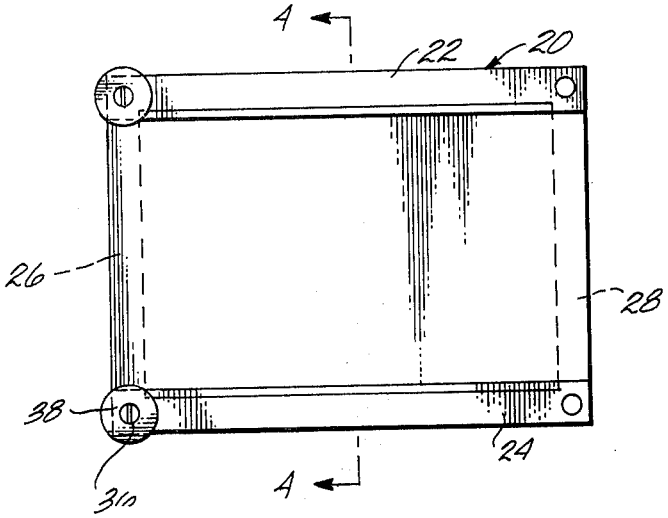
Fig. 3
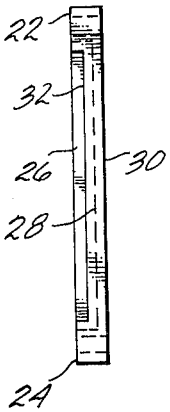
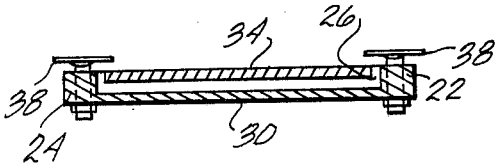
Fig. 4

TENNIS RACQUET SOUNDING DEVICE

FIELD OF THE INVENTION

This invention relates to a sounding device attachable to a tennis racket for providing an audible indication that the ball is being struck by the racket within a defined area of the strings. In learning to stroke with a tennis racket, it is highly important that the player reinforce his practice effort by learning where on the racket he is making contact with the tennis ball. There is central area slightly closer to the handle end of the racket where contact with the tennis ball produces the maximum response. This area, known as the "sweet spot," produces negligible reaction at the grip end of the handle when impacting the tennis ball. It is difficult for a student or an instructor to know whether a player is consistently hitting or missing the sweet spot.

SUMMARY OF THE INVENTION

The present invention is directed to a sounding device which can be clamped to one side of the strings of the racket in the region corresponding to the sweet spot. A ball striking the racket in this area causes the device to produce a characteristic sound signaling the student and the instructor that the ball is making contact with the desirable area of the racket. As the point of impact moves further and further away from the sweet spot, the quality of the sound modifies in a characteristic manner, indicating to the trained ear the degree to which the player is failing to obtain the desired point of impact.

In brief, the present invention provides a sounding device comprising a rectangular frame having a pair of spaced parallel side members connected at their ends by a pair of bridging members. A backing plate secured to the frame forms a sounding board. A diaphragm of plastic material supported between the bridging members extends parallel to but is spaced slightly away from the backing plate. The surface of the diaphragm is substantially flush with the side members of the frame. The device is clamped to one side of the strings with the outer surface of the diaphragm in contact with the strings.

DESCRIPTION OF THE DRAWINGS

For a better understanding of the invention reference should be made to the accompanying drawings, wherein:

FIG. 1 shows a tennis racket with the sounding device attached;

FIG. 2 shows a plan view of the sounding device;

FIG. 3 is an end view of the sounding device;

FIG. 4 is a sectional view taken substantially on the line 4—4 of FIG. 2;

FIG. 5 is a perspective view of the mounting frame of the device;

DETAILED DESCRIPTION

Figure 6:
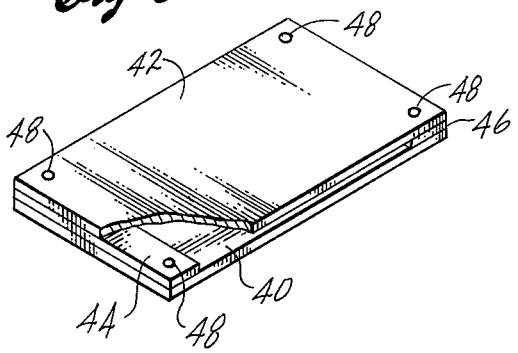
FIG. 6 is a perspective view of an alternative embodiment.

Referring to FIG. 1, the numeral 10 indicates generally a standard tennis racket having an oval shaped frame 12 and handle 14. The frame is strung with an interlaced grid 16 of stringing in a conventional fashion. The sounding device of the present invention, indicated generally at 18, is clamped against the strings in a central area corresponding generally to the so-called "sweet spot" which lies along an axis extending through the center of the handle and is located approximately a third of the way between the handle and the outer end of the frame.

The sounding device 18 as shown in detail in FIGS. 2–5 includes a generally rectangular mounting frame 20, including a pair of spaced parallel side members 22 and 24 joined at their ends by a pair of spaced parallel bridging members 26 and 28. The frame members are preferably rectangular in cross-section and made from a single piece of material, such as molded plastic. A thin backing plate 30 extends across one side of the frame. The backing plate may be integral with the frame or be a separate sheet of thin material bonded to the frame.

The bridging members 26 and 28 are notched to form recesses in the top surfaces of the bridging members, as indicated at 32. A thin rectangular diaphragm 34 preferably made of a hard, rigid plastic material, such as Formica, spans the frame between the bridging members 26 and 28. The diaphragm is seated in the recesses 32 so that the top surface of the diaphragm is substantially flush with the top surfaces of the side members 22 and 24. The width of the diaphragm is less than the distance between the inner margins of the side members 22 and 24 of the frame 20. Thus the air space between the diaphragm and the parallel flat surface of the backing plate 30 is open along the margins of the diaphragm.

To secure the sounding device to the racket, screws 36 are provided at the four corners of the frame. The screws are provided with washers 38 which act to clamp the frame and diaphragm against the surface of the strings. The screw heads are recessed in the washers so that a smooth surface is provided on one side of the racket which does not interfere with the striking of the tennis ball. While the preferred embodiment has a rectangular shape, the diaphragm may be of other shapes if desired. Likewise the specific frame arrangement can be modified in shape.

In operation, with the sounding device attached to the racket in the manner shown in FIG. 1, a player may practice striking the ball using only the side of the racket opposite the side against which the sounding device is clamped. When the ball strikes the strings where they engage the surface of the diaphragm 34, the strings and diaphragm make a distinct and sharp slapping sound. This sound is amplified by the backing plate 30 and is easily distinguished from the sound of the ball striking other areas of the racket. Balls struck slightly to one side of the diaphragm still produce a unique audible sound but the quality and intensity of the sound diminishes as the point of impact is moved further and further from the sweet spot. Thus a sounding device is provided which has been found highly useful in training a person to strike the ball effectively with the racket.

An alternative construction is shown in FIG. 6 in which the sounding device is formed by a pair of thin parallel plates preferably of a rigid plastic material such as Formica, as indicated at 40 and 42. The plates 40 and 42 are held in spaced parallel relationship by spacer members 44 and 46 extending along opposite ends of the plates 40 and 42. The entire unit is then secured to one side of the strings by suitable bolts (not shown) extending through holes 48 at the respective corners. The sounding device of FIG. 6 is secured to the strings of the racket in the same manner as the embodiment described above in connection with FIGS. 1 through 5.

Figure 7:
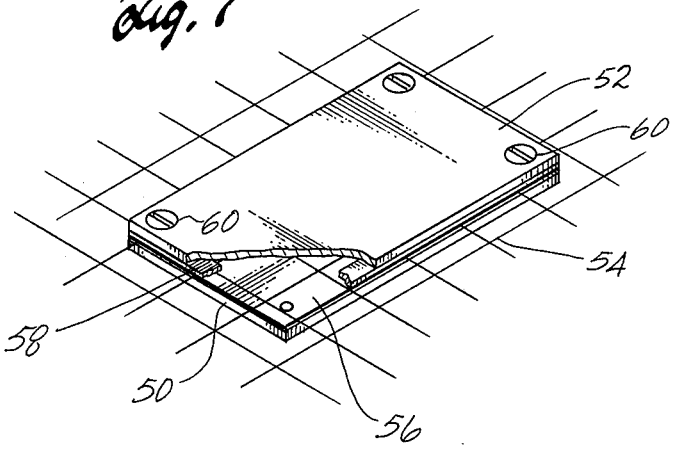
FIG. 7 is a perspective view of yet another embodiment.

A further modification is shown in FIG. 7 which is similar to the embodiment of FIG. 6 in that it comprises a pair of rectangaular plates 50 and 52 of rigid plastic material which are arranged in closely spaced parallel relationship. However, the plates 50 and 52 are mounted with the strings of the racket, indicated generally at 54, passing through the space between the parallel plates. Each plate is provided with a thin strip of material, indicated respectively at 56 and 58, applied to opposing surfaces around the margins. The strips 56 and 58 may be made of felt or other similar soft material which engage the strings and hold the plates 50 and 52 in spaced relationship to the strings. The plates are bolted together by screws 60 at each of the four corners. The plates 50 and 52 are sufficiently thin that striking the ball with the racket does not materially affect the trajectory even if the ball contacts the edge of one of the plates.

What is claimed is:

1. A tennis teaching device attachable to the strings at the center of a tennis racket comprising a frame member having a flat surface, means resiliently supporting a thin flat diaphragm on the frame member at spaced apart margins of said diaphragm, said diaphragm being further supported by said support means in parallel and spaced apart relationship to said flat surface of the frame member, whereby the center portion of the diaphragm is free to vibrate relative to said surface and emitting an audible sound when struck by a tennis ball, and means securing the frame member and diaphragm to the strings of a racket.

2. Apparatus of claim 1 wherein the diaphragm is made of stiff plastic material.

3. Apparatus of claim 1 wherein the diaphragm is substantially rectangular in shape.

4. Apparatus of claim 3 wherein the frame member includes a thin flat back portion forming said flat surface, and spaced parallel edge portions of slightly greater thickness than the back portion.

5. The apparatus of claim 4 wherein the frame member further includes an additional pair of edge portions of slightly greater thickness than the first mentioned edge portions and extending parallel to each other on either side of but spaced from the diaphragm, the additional pair of edge portions being adapted to engage the racket strings on either side of the diaphragm.

6. Apparatus of claim 1 wherein said means securing the frame member and diaphragm includes means for clamping the strings between the frame and diaphragm.

7. In a practice racket having an oval racket frame and handle attached to the frame with interlaced strings stretched across the frame, a sounding device for audibly indicating when a ball strikes the central area of the strings, comprising a frame including a pair of spaced parallel side members connected at their ends by a pair of parallel bridging members, the frame being open in the center, a backing plate secured to one side of the frame and spanning the opening, means securing a thin, flat diaphragm to the other side of the frame for oscillating movement relative thereto and spanning said opening, said diaphragm being spaced from and parallel to the backing plate, each side member having a surface substantially flush with the outer surface of the diaphragm, and means for clamping the frame to the strings in the central part of the string portion of the racket with the flush surfaces of the diaphragm and side members being held in contact with the strings whereby said diaphragm will oscillate when a ball strikes said strings at said central area.

* * * * *